United States Patent [19]

Faudemay

[11] 4,079,495

[45] Mar. 21, 1978

[54] ADJUSTMENT DEVICE FOR LIQUEFIED GAS LIGHTERS

[75] Inventor: Edmond L. J. Faudemay, Annecy-le-Vieux, France

[73] Assignee: S.T. Dupont, Paris, France

[21] Appl. No.: 748,834

[22] Filed: Dec. 9, 1976

Related U.S. Application Data

[62] Division of Ser. No. 668,558, Mar. 19, 1976.

[30] Foreign Application Priority Data

Mar. 21, 1975 France ..... 75 08909

[51] Int. Cl.[2] ..... B23Q 17/00

[52] U.S. Cl. ..... 29/404; 431/130; 251/287

[58] Field of Search ..... 431/130, 131, 142, 143, 431/127, 6, 12; 251/286, 287; 29/404

[56] References Cited

U.S. PATENT DOCUMENTS

| | | | |
|---|---|---|---|
| 2,994,341 | 8/1961 | Leopold, Jr. et al. | 251/287 X |
| 3,050,973 | 8/1962 | Goddard | 431/130 X |
| 3,213,648 | 10/1965 | Racek | 431/131 |

*Primary Examiner*—C.W. Lanham
*Assistant Examiner*—J. Rising
*Attorney, Agent, or Firm*—Richard A. Wise; Oistein J. Bratlie; Mandel E. Slater

[57] ABSTRACT

An adjustment device for liquefied gas lighters is disclosed, which allows precise automated setting of maximum and minimum permitted flame heights during the assembly of lighters which have a rotatable valve adjustment member extending from a valve well in the lighter. Fixed stop means are provided on the lighter. An adjustment mechanism rotates with the valve adjustment member and after adjustment of the flame height, movable stop means are formed in the adjustment mechanism in positions chosen such that the movable stop means can abut the fixed stop means at positions of the adjustment mechanism corresponding to maximum and minimum flame height, respectively.

6 Claims, 4 Drawing Figures

ADJUSTMENT DEVICE FOR LIQUEFIED GAS LIGHTERS

This is a division, of application Ser. No. 668,558, filed Mar. 19, 1976.

BACKGROUND OF THE INVENTION

1. Field of the Invention

This invention relates to cigarette lighters, and more particularly to flame adjustment devices for liquefied gas lighters.

2. Description of the Prior Art

A feature of liquefied gas cigarette lighters that has contributed to their wide popularity is the provision of means by which the height of the flame they produce can be conveniently and easily adjusted to suit the desires of different users and the requirements of various circumstances in which the lighters are employed. While the adjustment means may take on various forms of construction, at least with reference to the internal working valve parts, it is convenient to adopt a design which includes a rotatable valve adjustment member extending exteriorly from a valve well, which adjustment member may be coupled to an adjustment mechanism. Manual rotation of the adjustment mechanism then turns the valve adjustment member, which modifies the relationship of the internal working valve parts so as to regulate the rate of gas flow and thereby control flame height.

For safety and convenience, it is also desirable in the manufacture of an adjustable lighter, to fix the maximum and minimum allowed flame height settings. A built-in maximum flame height setting provides a safety factor, avoiding a dangerously high flame, which can catch the user unawares or cause excess still-liquid flaming droplets of fuel to be spattered about. A build-in minimum setting prevents one possible cause of user dissatisfaction by making it possible to reduce fuel flow to a rate at which a flame can not be sustained.

Some commercially-available liquefied gas lighters provide maximum and minimum flame height limits by incorporating stop means to limit rotation of the valve adjustment member or coupled adjustment mechanism. In a typical form of construction the lighter body may include a fixed stop which engages a moving stop or abutment surface on the adjustment mechanism to limit rotation thereof. The built-in flame adjustment in the manufacture of such a lighter would be accomplished typically by igniting a flame and rotating the valve adjustment member to the desired maximum flame height. Then the adjustment mechanism would be attached to the valve adjustment member with the adjustment mechanism oriented so that a movable stop on the adjustment mechanism is flush against a fixed stop on the lighter body, i.e. the adjustment mechanism is attached while positioned at one limit of its rotation. By design the opposite rotational limit of the adjustment mechanism provides the minimum flame height setting. Although such a construction prevents misuse by the consumer, it has an inherent drawback in that the adjustment mechanism must be attached to the lighter assembly after the setting is made, while the valve adjustment member is in one limiting position. This is difficult to accomplish in high-speed automated processes.

The adjustment mechanism is normally either a milled wheel provided with a grooved central opening which fits around a matching section of the valve adjustment member, the milled wheel therefore rotating with the valve adjustment member, but free to move in translation; or a lever with one end in the form of a flexible fork resting upon the grooved periphery of the valve adjustment member. In both cases, the separation between two adjacent engagement positions of the adjustment mechanism with respect to the valve adjustment member depends upon the angular spacing of the grooves. This leads to a lack of precision in adjusting the minimum and/or maximum flame height, because only a limited number of engagement positions are available.

Moreover, it is not possible to make the adjustment mechanism and the valve adjustment member as a single part, since the presence of stops on the adjustment mechanism would prevent it from being screwed into the valve well.

SUMMARY OF THE INVENTION

Accordingly it is an object of the present invention to provide an adjustment device for liquefied gas lighters in which the flame height limits may be preset by automated processes in the manufacture of the lighters.

A further object of the invention is the precise positioning of each adjustment stop, in order to improve accuracy in adjusting maximum and minimum flame height and, as a result, the safety of the lighter.

A still further object of the invention is the provision of an adjustment mechanism and valve adjustment member as a single part.

With the above objects in view a feature of the present invention is the provision of a liquefied gas lighter with adjustment means including fixed stop means on the lighter, a rotatable valve adjustment member coupled to an adjustable valve secured in a valve well in the ligher, an adjustment mechanism rotatable with the valve adjustment member, the adjustment mechanism having integral movable stop means interacting with the fixed stop means to limit rotation of the valve adjustment member at maximum and minimum flame height positions, with the movable stop means formed in the adjustment mechanism after it has been fitted to the lighter and after adjustment of the flame height.

The lighter is first adjusted to give a chosen flame height, then the controlled part or parts are fitted on the lighter, then the adjustment mechanism without stops, and, finally, the stops are formed, by any known method, for example by punching or stamping the adjustment mechanism, by machining, by bending, by inserting a pin through the wall of the adjustment mechanism, and so on.

In this manner it is also possible to make the adjustment mechanism and the valve adjustment member as a single part, because the absence of any stop on the adjustment mechanism at the time of fitting enables the valve adjustment member - adjustment mechanism combination to be inserted into the valve well.

The adjustment operation is thereby simplified and reduced to a rotation of the adjustment mechanism, a movement which can easily be carried out by an automatic machine.

in a preferred embodiment of the invention the adjustment mechanism consists of a milled wheel rotating with the valve adjustment member of the lighter and provided with an annular groove into which the fixed stop or stops on the lighter fit with clearance, the moving stops being formed in a wall of the groove.

The above and other features of the invention, including various novel details of construction and combinations of parts, will now be more particularly described with reference to the accompanying drawing and pointed out in the claims. it will be understood that the particular device embodying the invention is shown by illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which are shown illustrative embodiments of the invention from which its novel features and advantages will be apparent.

DESCRIPTION OF THE PREFERRED EMBODIMENTS

Figure 1:
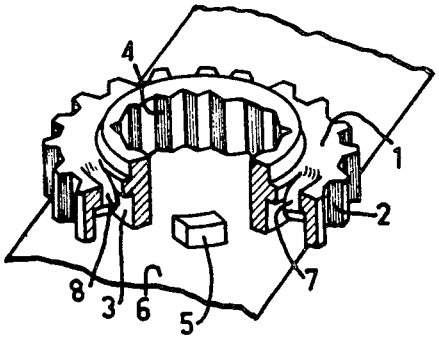
FIG. 1 is a perspective view, partially broken away, of a milled wheel including stops made according to the invention.

With reference to FIG. 1, the adjustment mechanism consists of a milled wheel 1 provided with teeth around its periphery 2, and annular groove 3. The milled wheel has an internal grooved bore 4 which fits on a corresponding part of a rotatable valve adjustment member, not shown, the valve adjustment member then rotating with the wheel.

When the milled wheel is in position, a fixed stop 5 which is fastened to the lighter body 6 enters the groove 3 with a certain clearance. Reference numeral 6 also designates the assembly consisting of the burner, the valve adjustment member and the valve well, the whole forming an insert which can be fitted into the lighter body. Once the milled wheel is fitted, the flame is adjusted to a given height by rotating the assembly of the milled wheel and valve adjustment member. Then the top surface of the groove 3 is cut away, for example by partial punching, so as to form in one or two operations, two movable stops 7 and 8 which project inside the groove at either side of the fixed stop 5. Depending upon the direction in which the milled wheel 1 is rotated, one or other of the movable stops will come into contact with the fixed stop 5. The position of the movable stops 7 and 8 and their angular separation are chosen such than when one or other of them bears against the stop 5, the flame height will be minimum or maximum respectively, the normal flame height being obtained when the stop 5 is equidistant from the movable stops 6 and 7.

Figure 2:
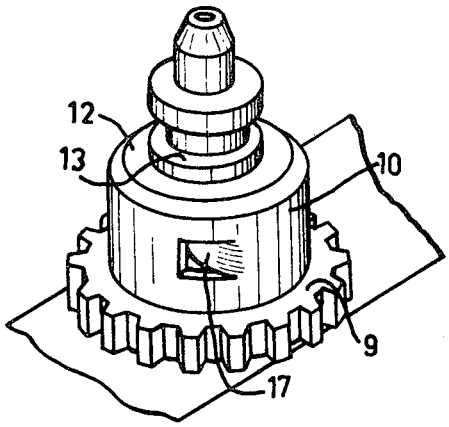
FIG. 2 is a perspective view of another type of adjustment mechanism connected to a valve adjustment member and on which the stops are arranged differently.
Figure 3:
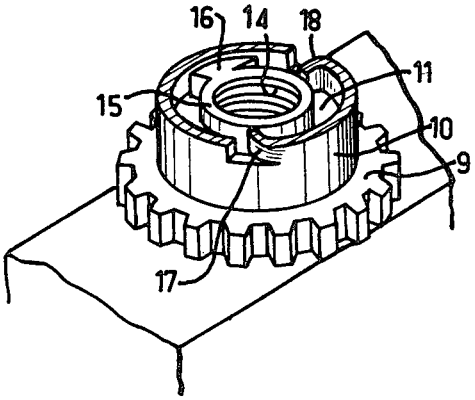
FIG. 3 is a cross-sectional view of the milled wheel of FIG. 2, taken parallel to the base.

The adjustment mechanism illustrated in FIGS. 2 and 3 comprises a milled base 9 surmounted by a tubular portion 10, which fits around a tubular projection 11 on the lighter body and terminates in a shoulder 12. with a grooved internal slot, which engages the corresponding grooves of the valve adjustment member 13. The assembly consisting of the valve adjustment member and the adjustment mechanism is screwed into a tapped hole 14 formed in a tubular portion 15 of the valve adjustment member. A radial stop 16, which forms part of the tubular portion 15, projects into the annular space between the portions 10 and 15.

After adjusting the flame to the desired height, two movable stops, 17 and 18 are formed, for example by punching, on the lateral tubular portion 10. These two movable stops project towards the inside and can come into contact with the fixed stop 16.

Figure 4:
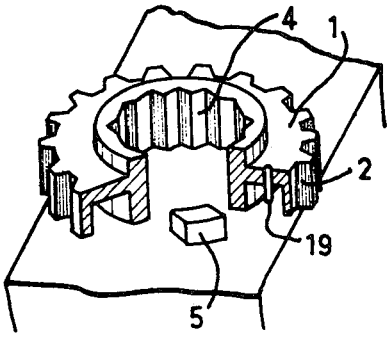
FIG. 4 is a view similar to FIG. 1, showing another method of making the milled wheel, in which the stop consists of a pin forming its own hole.

The adjustment mechanism illustrated on FIG. 4 is identical with that of FIG. 1, except that here the movable stops are in the form of pins, as at 19, lodged in milled wheel 1.

The movable stops may also be in the form of bosses formed, for example, by stamping or embossing.

It is to be recognized that the minimum and maximum flame heights may equally well be obtained by a combination of single movable stop and a sufficiently long fixed stop, or of a single movable stop and two fixed stops.

While various aspects of the invention have been illustrated by the foregoing detailed embodiments, it will be understood that various substitutions of equivalents may be made without departing from the spirit and scope of the invention.

I claim:

1. The method of providing maximum and minimum flame height limits on an adjustable lighter having a rotating flame height adjustment mechanism and at least one fixed stop on said lighter adjacent said adjustment mechanism, the method comprising fitting said adjustment mechanism on the part of said lighter it is intended to control, lighting a flame, rotating said adjustment mechanism to a predetermined flame height, and then deforming said adjustment mechanism to provide at least one stop movable with said adjustment mechanism and in position to interact with said fixed stop to limit rotation of said adjustment mechanism between maximum and minimum flame height.

2. The method as described in claim 1, in which said deforming step comprises punching said adjustment mechanism.

3. The method as described in claim 1, in which said adjustment mechanism has at least one wall, and in which said deforming step comprises modifying the shape of said wall of said adjustment mechanism to provide at least one boss.

4. The method as described in claim 1, in which said adjustment mechanism has at least one wall, and in which said deforming step comprises extending a pin through said wall of said adjustment mechanism.

5. The method as described in claim 1, in which said predetermined flame height is the maximum desired flame height.

6. The method as described in claim 1, in which said predetermined flame height is the minimum desired flame height.

* * * * *

UNITED STATES PATENT OFFICE

CERTIFICATE OF CORRECTION

PATENT NO. : 4,079,495

DATED : March 21, 1978

INVENTOR(S) : EDMOND L. J. FAUDEMAY

It is certified that error appears in the above-identified patent and that said Letters Patent are hereby corrected as shown below:

Column 1, line 39 change "possible" to -- impossible --

Column 3, line 59 change "6 and 7" to -- 7 and 8 --

Signed and Sealed this

*Seventh* Day of *November 1978*

[SEAL]

*Attest:*

RUTH C. MASON
*Attesting Officer*

DONALD W. BANNER
*Commissioner of Patents and Trademarks*